US008418487B2

(12) United States Patent
King

(10) Patent No.: US 8,418,487 B2
(45) Date of Patent: Apr. 16, 2013

(54) WATER CHILLER ECONOMIZER SYSTEM

(76) Inventor: Martin P. King, Diamond Springs, CA (US)

( * ) Notice: Subject to any disclaimer, the term of this patent is extended or adjusted under 35 U.S.C. 154(b) by 1365 days.

(21) Appl. No.: 11/787,720

(22) Filed: Apr. 17, 2007

(65) Prior Publication Data

US 2007/0240438 A1 Oct. 18, 2007

Related U.S. Application Data

(60) Provisional application No. 60/792,778, filed on Apr. 17, 2006.

(51) Int. Cl.
*F25D 17/02* (2006.01)

(52) U.S. Cl.
USPC ..... 62/185; 62/79; 62/118; 62/129; 62/201; 62/430; 62/513

(58) Field of Classification Search ..... 62/79, 185, 62/513, 430, 201, 260, 129, 118
See application file for complete search history.

(56) References Cited

U.S. PATENT DOCUMENTS

| | | | | |
|---|---|---|---|---|
| 2,200,215 | A | 5/1940 | Lewis | |
| 2,892,321 | A | 6/1959 | Kritzer | |
| 4,559,788 | A | 12/1985 | McFarlan | |
| 4,761,967 | A * | 8/1988 | Sumikawa et al. | 62/201 |
| 4,926,649 | A | 5/1990 | Martinez, Jr. | |
| 5,088,292 | A | 2/1992 | Champagne et al. | |
| 5,341,649 | A | 8/1994 | Nevitt et al. | |
| 5,411,078 | A | 5/1995 | Ares | |
| 5,626,025 | A | 5/1997 | Hyde | |
| 5,735,133 | A * | 4/1998 | Voss et al. | 62/185 |
| 5,819,546 | A | 10/1998 | Uchida | |
| 5,946,926 | A | 9/1999 | Hartman | |
| 6,047,559 | A | 4/2000 | Tanaka et al. | |
| 6,148,634 | A * | 11/2000 | Sherwood | 62/434 |
| 6,158,499 | A | 12/2000 | Rhodes et al. | |
| 6,176,102 | B1 | 1/2001 | Novak et al. | |
| 6,196,168 | B1 | 3/2001 | Eckerskorn et al. | |
| 6,250,090 | B1 | 6/2001 | Mei et al. | |
| 6,279,330 | B1 | 8/2001 | Ueno et al. | |
| 6,370,889 | B2 | 4/2002 | Okazaki et al. | |
| 6,718,779 | B1 | 4/2004 | Henry | |
| 6,871,509 | B2 | 3/2005 | Grabon et al. | |

* cited by examiner

*Primary Examiner* — Frantz Jules
*Assistant Examiner* — Azim Abdur Rahim
(74) *Attorney, Agent, or Firm* — Roger D. Emerson; Emerson Thomson Bennett

(57) ABSTRACT

A process-fluid chiller system for chilling a process fluid to be transported to a process load to remove thermal energy from the process load. The process-fluid chiller system includes a storage tank in which the process fluid can be stored, and a refrigeration system that can be selectively activated to chill the process fluid. The refrigeration system includes an evaporation device for evaporating a refrigerant from a liquid state to a gaseous state and a compressor for elevating a pressure of the refrigerant in the gaseous state. A temperature sensor is included for sensing a temperature of an exchange medium to which thermal energy from the process fluid can be transferred when the temperature of the exchange medium falls below a predetermined low temperature. Also included is a closed-loop heat exchanger that can selectively be placed in fluid communication with the storage tank and selectively taken out of fluid communication with the storage tank based at least in part on the sensed temperature of the exchange medium. The process-fluid chiller system further includes a control system for controlling activation of the refrigeration system and selective placement of the closed-loop heat exchanger in fluid communication with the storage tank.

6 Claims, 8 Drawing Sheets

WATER CHILLER ECONOMIZER SYSTEM

CROSS-REFERENCE TO RELATED APPLICATIONS

This application claims the benefit of U.S. Provisional Application No. 60/792,778, filed on Apr. 17, 2006 entitled Water Chiller Economizer System.

BACKGROUND OF THE INVENTION

1. Field of the Invention

This invention relates generally to the field of refrigeration systems, and more particularly to an electronically-controlled process fluid chilling system including a chiller and a dry cooler providing a heat exchange between an exchange medium and the process fluid flowing through the dry cooler. And even more particularly, embodiments of the present invention also relate to a microprocessor-based controller for implementing the system.

2. Description of Related Art

Conventional refrigeration systems utilize a refrigerant that removes heat from a fluid used for cooling applications and ejects the removed heat to a heat sink in an ambient environment of the refrigeration system. The heat sink can be ambient air or a fluid such as water from a cooling tower in thermal communication with the refrigeration system. An example of such a refrigeration system is a water chiller that transfers thermal energy from water to the refrigerant during a chilling cycle to chill the water. The chilled water is then transported through a piping system to remove thermal energy from a warm environment or a piece of processing equipment as desired.

In operation, these conventional refrigeration systems take advantage of state changes experienced by the refrigerant to remove the thermal energy from a process fluid and subsequently release that removed thermal energy to ambient air, water from a cooling tower or other suitable ambient environment of the refrigeration system. But regardless of the heat sink to which thermal energy is removed from the refrigerant, a compressor for elevating the pressure of the refrigerant must be operational to chill the process fluid.

Continuing with the example of a water chiller, a compression type water chiller draws low-pressure refrigerant gas into a compressor, where it is compressed and discharged as a high-pressure refrigerant gas. Due to the relationship between the pressure and temperature of the refrigerant, the temperature of the refrigerant gas is also raised to an elevated temperature above the temperature of the low-pressure refrigerant gas when it is introduced to the compressor. This hot refrigerant gas flows through a conduit to be introduced to a condenser. The hot refrigerant gas condenses as it travels through the conduit and in the condenser before entering an evaporator to which the water is also introduced during the chilling cycle. As the liquid refrigerant and water to be chilled travel through the evaporator, the liquid refrigerant rapidly expands and evaporates into a gas. The required thermal energy, commonly referred to as the latent heat of vaporization, to accomplish this state change of the refrigerant from liquid to gas is drawn from the water being chilled, thereby chilling the water.

Large refrigeration systems often demand significant chilling capacity to provide a sufficient amount of chilled fluid to adequately cool large processes and process equipment operating at very high temperatures. To meet such demands the refrigeration system discussed above requires large compressors which tend to be inefficient and costly. Further, these compressors must be continuously operated to satisfy chilling demands, leading to large operational costs.

To minimize the costs associated with large refrigeration systems in chilling water, cooling towers have been employed to directly chill water used in industrial cooling applications. Cooling towers direct air through a stream of water in a direction that is perpendicular to the flow direction of the water. The airflow causes at least some of the water to evaporate, thereby chilling the water as it flows through the cooling tower. However, cooling towers are limited in their ability to adequately chill water based on the temperature and relative humidity in their ambient environment. This prohibits the use of cooling towers as options for chilling water or other process fluids in many geographic regions. Further, processes that utilize water directly from a cooling tower to cool process equipment typically require the water to be conditioned to remove foreign matter collected from the water while it was exposed to the ambient environment during cooling before being transported to the equipment to be cooled.

Accordingly, there is a need in the art for a process fluid chiller for cooling a process fluid. The chiller can optimize efficiency by utilizing a secondary fluid in a closed-loop secondary cooler, and can optionally be responsive to one or more sensed environmental conditions to adjust operation of the refrigeration system. Further, the chiller can optionally include a microprocessor-based control unit for governing operation of the chiller according to application specific computer-executable instructions.

BRIEF SUMMARY OF THE INVENTION

According to one aspect, the present invention provides a process-fluid chiller system for chilling a process fluid to be transported to a process load to remove thermal energy from the process load. The process-fluid chiller system includes a storage tank in which the process fluid can be stored, and a refrigeration system that can be selectively activated to chill the process fluid. The refrigeration system includes an evaporation device for evaporating a refrigerant from a liquid state to a gaseous state and a compressor for elevating a pressure of the refrigerant in the gaseous state. A temperature sensor is included for sensing a temperature of an exchange medium to which thermal energy from the process fluid can be transferred when the temperature of the exchange medium falls below a predetermined low temperature. Also included is a closed-loop heat exchanger that can selectively be placed in fluid communication with the storage tank and selectively taken out of fluid communication with the storage tank based at least in part on the sensed temperature of the exchange medium. The process-fluid chiller system further includes a control system for controlling activation of the refrigeration system and selective placement of the closed-loop heat exchanger in fluid communication with the storage tank.

According to another aspect, the present invention provides a process-fluid chiller system wherein the heat exchanger is coupled to an exterior surface of a housing enclosing the process fluid chiller system as part of a unitary structure.

According to yet another aspect, the present invention provides a process-fluid chiller system including a control system that comprises a microprocessor that transmits a control signal that causes activation of the refrigerating system of said process chiller when the sensed temperature of the exchange medium is greater than or equal to a predetermined warm temperature. The microprocessor can further transmit a control signal that causes deactivation of the refrigeration system when the sensed temperature of the exchange medium is less than or equal to the predetermined low temperature.

According to yet another aspect, the present invention provides a process-fluid chiller system according comprising a fan provided adjacent to the heat exchanger for blowing ambient air as the exchange medium over a conduit through which the process fluid can flow to transfer thermal energy from the process fluid to the ambient air. The conduit can optionally be fabricated from copper, aluminum, or an alloy thereof. Other aspects include a process-fluid chiller system including a conduit provided to the heat exchanger that is fabricated from a material having a coefficient of thermal conductivity of at least 15 W/mK.

BRIEF DESCRIPTION OF THE DRAWINGS

The invention may take physical form in certain parts and arrangement of parts, embodiments of which will be described in detail in this specification and illustrated in the accompanying drawings which form a part hereof, and wherein.

DETAILED DESCRIPTION OF ILLUSTRATIVE EMBODIMENTS

Figure 1:
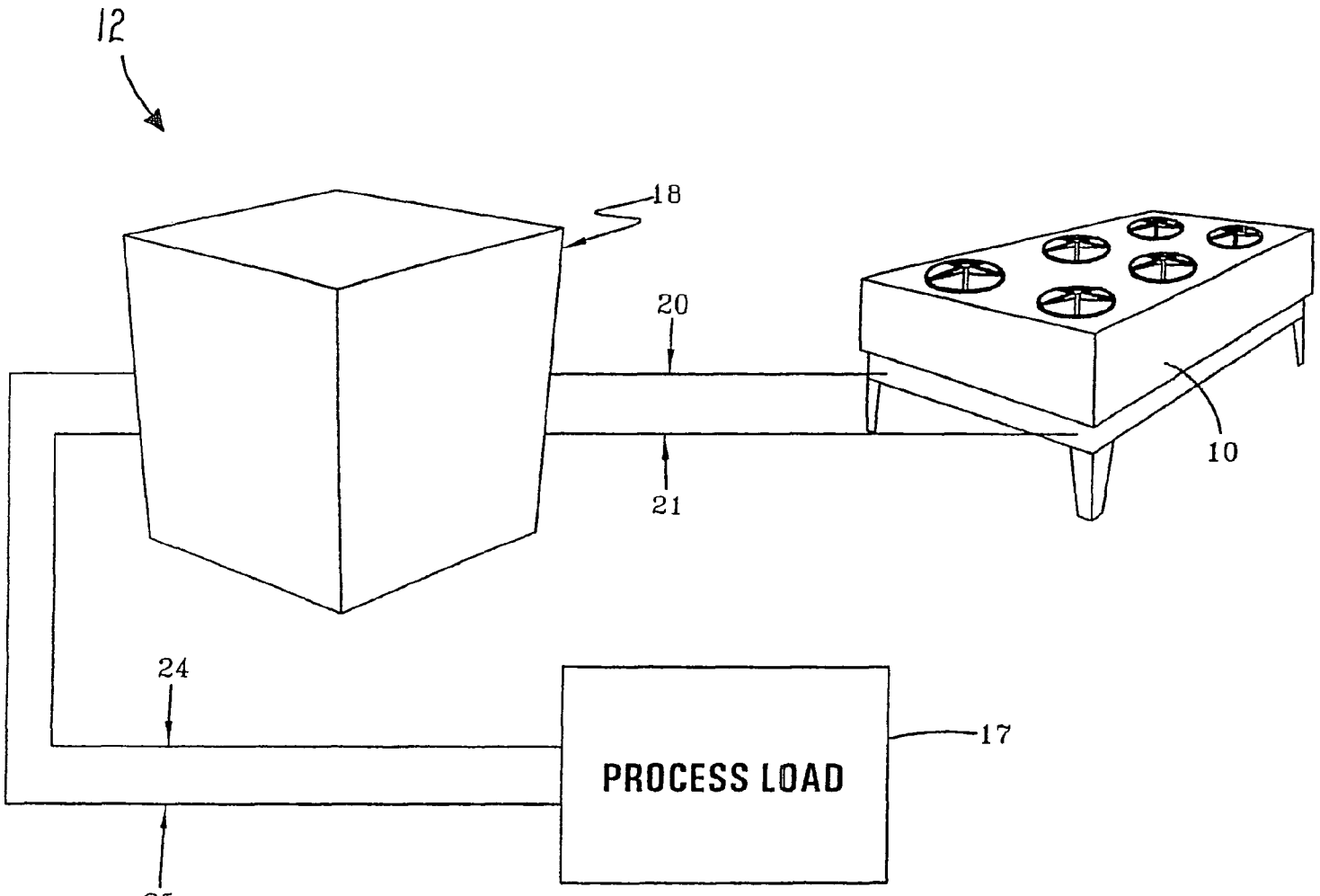
FIG. 1 is a schematic view of one embodiment of a process fluid chiller according to an illustrative embodiment of the present invention showing an arrangement of a process chiller, dry cooler and process load.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

FIG. 1 shows a perspective view of an illustrative embodiment of a process fluid chiller system 12 according to the present invention. As shown, the chiller system 12 includes a refrigeration-based process chiller 18 and a dry cooler 10 that can cooperate or operate as alternatives to chill a process fluid for cooling a process load 17. The process load 17 can be a warm environment that requires cooling, one or more pieces of process equipment or hardware included as part of an industrial, commercial or other type of process. The process load 17 can be cooled by introducing the chilled process fluid directly into a cavity or internal passage formed in the piece of equipment, by introducing the chilled process fluid to a cooling jacket wrapped about the piece(s) of equipment, and the like. But regardless of the manner in which the chilled process fluid is introduced to the process load 17, thermal energy from the process load 17 is transferred to the chilled process fluid to bring about cooling of the process load 17. Thus, cooling of the process load 17 is understood to be the reduction of the process load's temperature to a lowered temperature that is less than the temperature of the process load 17 before the introduction of the chilled process fluid to the process load 17.

Figure 3A:
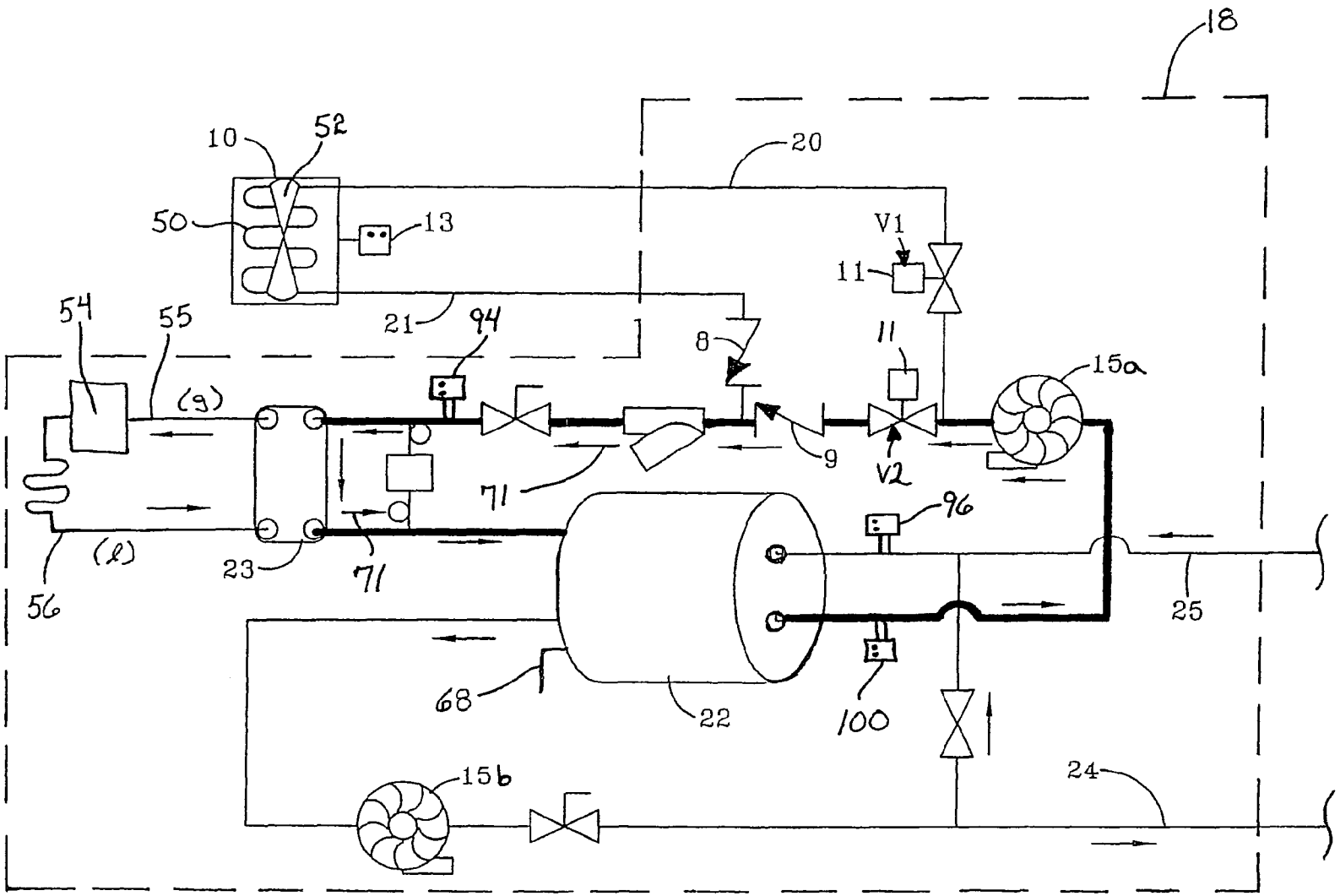
FIG. 3A is a schematic representation of an embodiment of a process fluid chilling system showing the dry cooler shut off from a refrigeration-based process chiller when ambient air temperature is above a predetermined cooling temperature of the system.
Figure 3B:
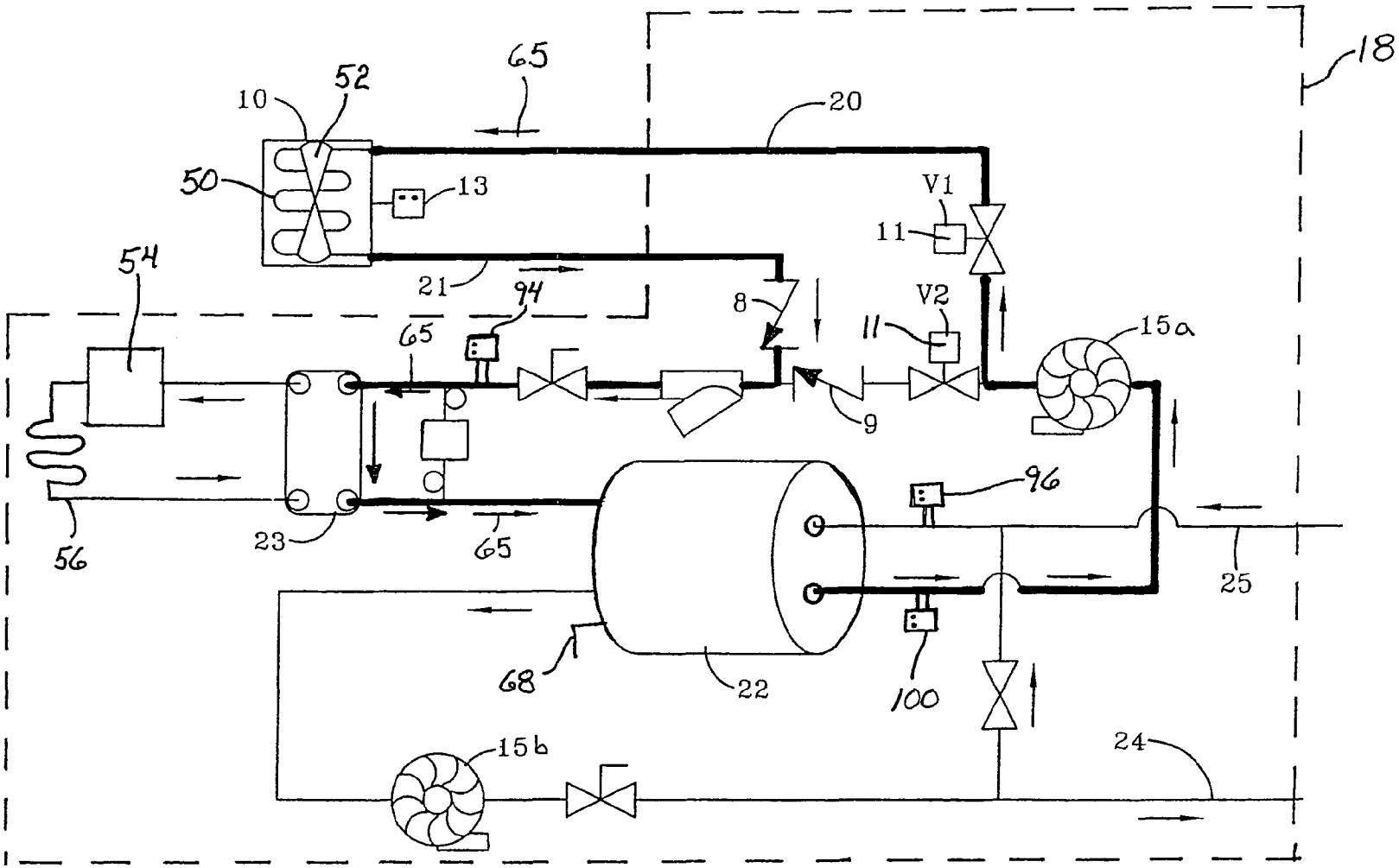
FIG. 3B is a schematic representation of an embodiment of a process fluid chilling system showing the dry cooler forming part of the chilling cycle by being operatively coupled to the refrigeration-based process chiller in operation when the ambient air temperature is below a predetermined cooling temperature of the system.

The refrigeration-based process chiller 18, shown schematically as broken lines in FIGS. 3A and 3B, includes a storage tank 22 for storing the chilled process fluid for cooling the process load 17. The storage tank 22 can optionally be integrated within an interior of the refrigeration-based process chiller 18, or provided externally of the refrigeration-based process chiller 18 as desired. The refrigeration-based process chiller 18 is operatively coupled in fluid communication with a dry cooler 10 by at least one input pipe 20 and at least one return pipe 21 that collectively form a closed loop between the refrigeration-based process chiller 18 and the dry cooler 10. Thus, process fluid can be transported from the storage tank 22 to the dry cooler 10 under desirable circumstances as described in detail below to remove thermal energy from, and thereby chill the process fluid.

Although referred to as pipes 20, 21, the pipes 20, 21 establishing the fluid-flow path between the refrigeration-based process chiller 18 and the dry cooler 10 can be any fluid-transporting conduit fabricated from any suitable material, and can be rigid, semi-rigid, or flexible as desired. Examples of suitable pipes 20, 21 include rigid pipes formed from stainless steel, cast iron, aluminum, polyvinyl chloride ("PVC") or other non-metallic material, any combination thereof, and the like. Further, either or both of the pipes 20, 21 can optionally be insulated to minimize the transfer of thermal energy between the ambient environment and the process fluid in the pipes 20, 21.

The term "dry cooler" 10 is used to refer to a closed-loop heat exchanger for chilling the process fluid with an exchange medium while completely isolating the process fluid from the exchange medium during the transfer of thermal energy from the process fluid to the exchange medium. Accordingly, the process fluid and the exchange medium are not combined, and remain isolated from each other during the heat exchange process facilitated by the dry cooler 10. To so isolate the process fluid, the dry cooler 10 includes a conduit 50 defining an internal passage through which the process fluid can travel under desirable conditions to be chilled, and about which the exchange medium is disposed to remove thermal energy from the process fluid within the conduit 50. Since the process fluid travels through a closed loop to and from the dry cooler 10, and since the process fluid and exchange medium remain isolated from each other, the chilled process fluid can be introduced to the process load 17 without first being conditioned to remove foreign objects collected while being chilled with the dry cooler 10. The conduit 50 can optionally be arranged in a coiled or other circuitous pattern to maximize the surface area of the conduit 50 exposed to the exchange medium about the conduit 50. Maximizing the surface area of the conduit exposed to the exchange medium elongates the internal passage defined by the conduit 50 through which the process fluid travels to maximize the time during which the process fluid transfers thermal energy to the exchange medium. Further, the maximized surface area also maximizes the area of the heat-transfer surface through which thermal energy can be conducted from the process fluid to the exchange medium within the dry cooler 10.

The material from which the conduit 50 can be formed includes any material that is considered to be a conductor of thermal energy and has a high coefficient of thermal conductivity (k). Examples of suitable materials from which the conduit 50 can be formed include metals such as aluminum, copper and alloys thereof; and any material having a coefficient of thermal conductivity of at least 15 W/mK [Watts/(meters*Kelvin)]. Other embodiments include one or more conduits 50 formed from a material having a coefficient of thermal conductivity k greater than any of the group consisting of, 20 W/mK, 25 W/mK, 30 W/mK, 35 W/mK, 40 W/mK, 50 W/mK, 100 W/mK, 150 W/mK, 200 W/mK, 250 W/mK, 300 W/mK, 350 W/mK, and 400 W/mK.

Suitable exchange media include any naturally-available fluid with a temperature that is at some point in time less than the temperature of the process fluid introduced to the dry cooler 10 via the input pipe 20. For example, the exchange medium can be the ambient air of the environment in which the dry cooler 10 is located, water from a body of water located adjacent to the dry cooler 10 such as a pond, naturally flowing water such as that flowing in a stream or river flowing adjacent to the dry cooler 10, and the like. Other embodiments can optionally utilize a fluid that is not necessarily in its natural environment, such as water from a cooling tower for example. Yet other embodiments include an exchange medium that is not a fluid, but a solid. According to such embodiments, the exchange medium can include subterranean soil beneath a region in the vicinity of the dry cooler 10 for example. Then, thermal energy from the process fluid traveling through the conduit 50 is transferred to the subterranean soil, which remains at a relatively-constant temperature year round, regardless of the ambient environment's temperature above ground.

According to an illustrative embodiment, the dry cooler 10 includes a liquid-to-air heat exchanger. Water or other process fluid to be chilled is pumped through the input pipe 20, through the conduit 50, and back to the refrigeration-based process chiller 18 through the return pipe 21. As the water passes through the conduit 50, a fan 52 blows ambient air as the exchange medium over the process-fluid-containing conduit 50, thereby removing thermal energy from, and chilling the process fluid. Due to the transfer of thermal energy to the ambient air, the bulk temperature of the process fluid is lowered to a temperature that is lower than the bulk temperature of the process fluid when introduced to the dry cooler 10. Removing thermal energy from water with the dry cooler 10 in this manner is appropriate when the ambient air blown over the conduit has a temperature that is lower than the temperature of the process fluid introduced to the dry cooler 10.

The process fluid chiller system 12 also includes a refrigeration system, which can optionally be integrated within the refrigeration-based process chiller 18 as shown in FIGS. 3A and 3B. The refrigeration system includes a compressor 54 in fluid communication with an evaporator 23. The evaporator 23 shown in FIGS. 3A and 3B also includes a heat-transfer surface through which thermal energy is transferred from the process fluid being chilled to a refrigerant. Examples of suitable refrigerants include, but not limited to hydrochlorofluorocarbons, chlorofluorocarbons, bromofluorocarbons, hydrofluorocarbons, perfluorocarbons, environmentally-friendly replacements thereof, any combination thereof, and the like. In operation, the refrigeration system takes advantage of state changes experienced by the refrigerant to remove the thermal energy from, and thereby chill the process fluid. Referring once again to the embodiment where the process fluid is water, low-pressure refrigerant gas is drawn into the compressor 54, where it is compressed and discharged in the direction of arrow 55 as a high-pressure refrigerant gas. Due to the relationship between the pressure and temperature of a fluid, the temperature of this high-pressure refrigerant gas is also raised to an elevated temperature above the temperature of the low-pressure refrigerant gas when it is introduced to the compressor 54. The hot refrigerant gas flows through a conduit 56 to at least partially condense en route to the evaporator 23. The hot refrigerant gas condenses as it travels through the conduit 56 before entering the evaporator 56 to which the water is also introduced during the chilling cycle. An expansion valve disposed within the evaporator 23 causes the condensed refrigerant liquid to rapidly expand, thereby evaporating into a gas. The required thermal energy, commonly referred to as the latent heat of vaporization, to accomplish this state change of the refrigerant from liquid to gas is drawn from the water being chilled. This removal of the thermal energy from the water reduces its temperature to a temperature that is lower than the temperature of the water prior to being introduced to the evaporator 23.

A network of valves V1, V2 can be actuated as described in detail below to selectively include the dry cooler 10 in the fluid flow pathway through which the process fluid travels to be chilled, a pathway referred to herein as the chilling cycle. The valves V1 and V2 define one embodiment of a valving arrangement. The valves V1, V2 can be any type of electronically controlled valve such as a solenoid valve for example. A solenoid 11 provided to each valve V1, V2 can be energized to open and close the valves V1, V2. According to the embodiment shown in FIGS. 3A and 3B, valve V1 is normally closed while valve V2 is normally open. With neither solenoid 11 energized, this normal configuration of valves V1, V2 establishes a default chilling cycle that bypasses the dry cooler 10, as indicated by the arrows 71 and the bolded fluid flow path shown in FIG. 3A. Energizing the solenoid 11 provided to each valve V1, V2 as described below opens valve V1 and closes valve V2, thereby altering the chilling cycle to include the dry cooler 10 in series with the evaporator 23, as shown by arrows 65 and the bolded fluid flow path shown in FIG. 3B.

Regardless of whether the water or other process fluid is chilled by the refrigeration system or the dry cooler 10, the chilled water or other process fluid is stored in the storage tank 22 until it is withdrawn as needed to provide cooling to the process load 17. Pipe 24 supplies chilled process fluid to process load 17 from the storage tank 22 to the process load 17 and fluid pipe 25 returns the process fluid from the process load 17 to the refrigeration-based process chiller 18, where the process fluid can once again be chilled as needed. The process fluid can be chilled before being returned to the storage tank 22 after cooling the process load 17, or it can be returned to the storage tank 22 and mixed with remaining process fluid that can be selectively chilled as desired to maintain a suitable temperature for cooling the process load 17.

A plurality of temperature sensors are distributed about the process fluid chiller system 12 to monitor and detect temperature fluctuations of the process fluid. As shown in FIGS. 3A and 3B, a return fluid temperature sensor 96 is positioned along fluid pipe 25 to sense the temperature of the process fluid downstream from the process load. In other words, the return fluid temperature sensor 96 senses the temperature of the process fluid after it has cooled the process load 17 as it is returning to the storage tank 22. Each of the temperature sensors discussed herein, including the return fluid temperature sensor 96, can be a thermocouple provided to the fluid pipe 25 or any other suitable device that can sense the temperature of the process fluid within the fluid pipe 25 and transmit a signal indicative of that sensed temperature to be received by the microcontroller 92.

Likewise, an evaporation inlet temperature sensor 94 is provided to the plumbing conduit leading to the evaporator 23 of the refrigeration-based process chiller 18. This evaporation inlet temperature sensor 94 can sense the temperature of the process fluid after the process fluid leaves the storage tank 22, downstream of the dry cooler 10 in the chilling cycle, and before it enters the evaporator 23. In response, the evaporation inlet temperature sensor 94 transmits a signal indicative of this sensed temperature to be received by input R of an economizer microcontroller 98 (discussed below with reference to FIG. 2B). The economizer microcontroller 98 controls operation of the dry cooler 10 and the cooperation of the dry cooler 10 with the refrigeration-based process chiller 18 to efficiently chill the process fluid depending on the sensed temperature of the available exchange medium. Similarly, a recirculation inlet temperature sensor 100 is also operatively coupled to communicate a signal indicative of the temperature of the process fluid as the process fluid leaves the storage tank 22 and upstream of the dry cooler 10. The signal indicative of this sensed temperature is to be received by input S of the microcontroller 92 as well as input B of the economizer microcontroller 98.

An exchange medium temperature sensor 13 is disposed at a location from where it can sense the temperature of the exchange medium that is available to receive thermal energy from the process fluid as it passes through the dry cooler 10. When ambient air is to be blown over the conduit 50 as the exchange medium, the exchange medium temperature sensor 13 is operatively coupled to the economizer microcontroller 98 to communicate a signal indicative of the exchange medium's temperature that is to be received by input A of the economizer microcontroller 98.

One or more additional sensors can optionally be provided to the process fluid chiller system 12 to sense any critical condition(s) that could indicate a malfunction of the process fluid chiller system 12. These one or more additional sensors form a critical condition sensor array 102 (FIG. 2A) that can, for example, detect an overpressure of process fluid anywhere in the chilling cycle, the unexpected termination and operation of one or more components of the process fluid chiller system 12, and the like. Upon detecting a critical condition, the critical condition sensor array 102 transmits a signal to be communicated to input T of the microcontroller 92 that, when received, causes deactivation of the dry cooler 10 and removal of the dry cooler 10 from the chilling cycle until the critical condition can be rectified.

Each of the sensors described above is operatively coupled to communicate their respective signals to at least one of the microcontrollers of the process fluid chiller system 12. From FIG. 2A, it can be seen that the return fluid temperature sensor 96, the recirculation inlet temperature sensor 100 and the critical condition sensor array 102 each communicate their respective signals to the stock microcontroller 92. From FIG. 2B, it can be observed that the exchange medium temperature sensor 13, recirculation inlet temperature sensor 100 and evaporation inlet temperature sensor 94 each communicate their signals to the economizer microcontroller 98.

Figure 2A:
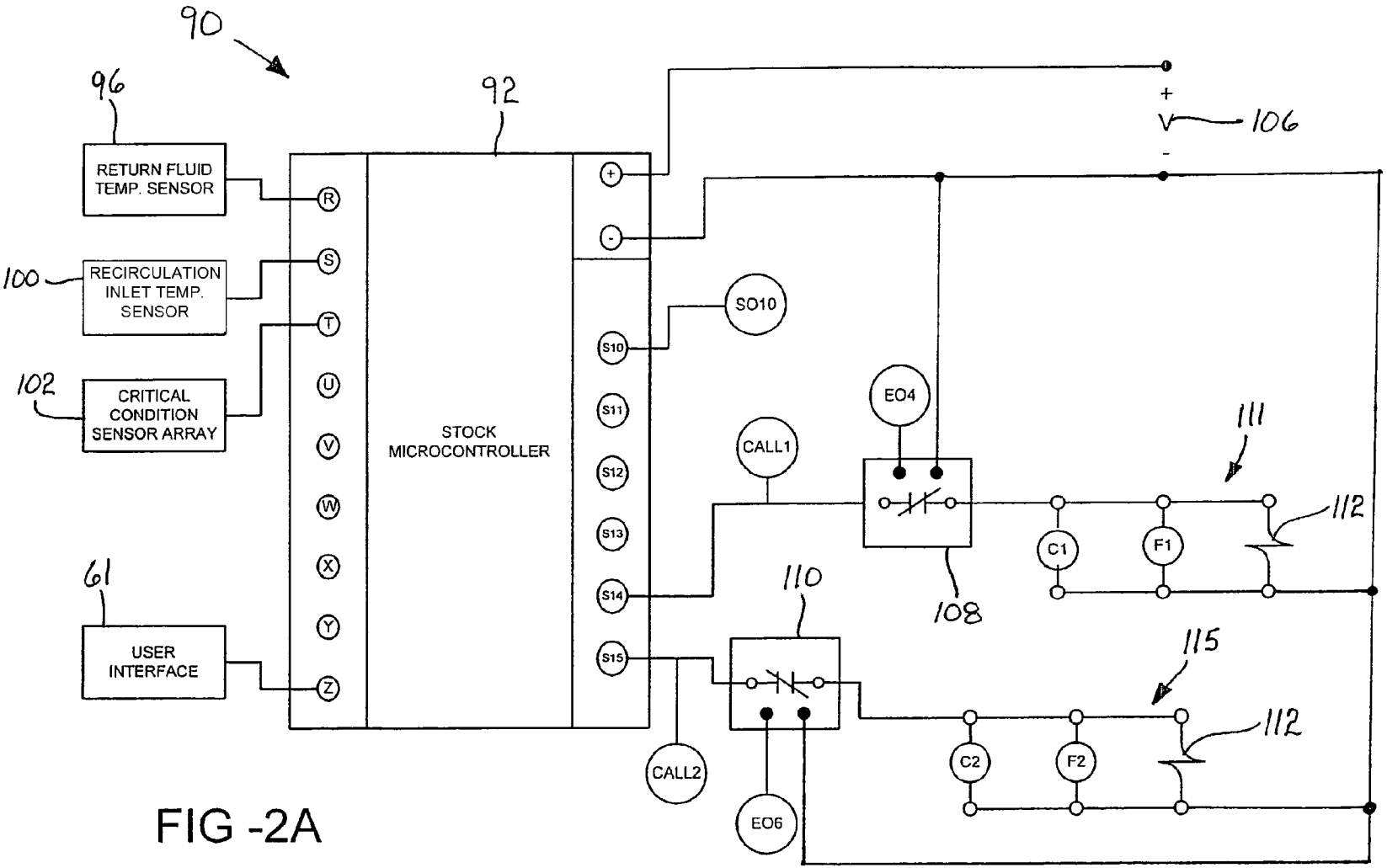
FIG. 2A is a block diagram of a microprocessor-based control system for controlling operation of a refrigeration system.

FIG. 2A is a block diagram of a stock microprocessor-based control system 90 for controlling operation of the refrigeration-based process chiller 18 of process fluid chiller system 12. The stock control system 90 includes a microprocessor 92 having a plurality of inputs (labeled R-Z) and a plurality of outputs (labeled S10-S15). The microprocessor 92 can be any integrated controller designed for use in an embedded system. The microprocessor 92 can include an integrated CPU; memory in the form of a small amount of RAM, ROM, or both; a plurality of I/O pins; and other peripherals on the same chip. An example of a suitable microprocessor 92 for the stock control system 90 is any microcontroller from PSG Controls, Inc. An operator can input commands governing operation of the process fluid chiller system 12 and any other such input command via a user interface 61 that is also operatively coupled to the microprocessor 16. The user interface 61 can be disposed at any location from where the operator can gain access to it to control operation of the process fluid chiller system 12.

As shown in FIG. 2A, the microcontroller 92 is operatively coupled to at least the return fluid temperature sensor 96 and recirculation inlet temperature sensor 100 to receive signals indicative of the temperature of the process fluid at a plurality of points within the chilling cycle. A power source 106 supplies electric energy having a suitable voltage, such as 24 V, for example, to power the microcontroller 92. At least a portion of this electric energy supplied by the power source 106 can be emitted as control signals from the outputs S10-S15 as appropriate to signal the existence of a known condition.

The microcontroller 92 in FIG. 2A is also operatively coupled to communicate control signals from outputs S14 and S15 to selectively energize normally-closed first compressor lockout relay 108 and normally-closed second compressor lockout relay 110, respectively. The embodiment shown in FIGS. 2A and 2B include a dual-stage refrigeration-based process chiller 18, which merely breaks up the chilling of the process fluid by the refrigeration-based process chiller 18 into two stages 111, 115, each including its own compressor 54 controlled by selectively energizing respective compressor contacts C1, C2. Thus, the two stages 111, 115 can be operated simultaneously or separately depending on the cooling demands. However, it is to be noted that the present invention is not limited to dual-stage refrigeration-based process chillers 18, but also includes a single stage refrigeration-based process chiller 18 as shown in FIGS. 3A and 3B, and any multi-stage refrigeration-based process chiller 18.

An output signal is transmitted from outputs S14 and S15 of the microcontroller 92 in FIG. 2A when the process fluid is to be chilled. A call for cooling is said to be made when the output signals are transmitted from outputs S14 and S15, which occurs when the temperature of the process fluid sensed by recirculation inlet temperature sensor 100 rises above a predetermined upper limit as described in detail below. The first and second compressor lockout relays 108, 110 are normally closed, thereby allowing the signal output from outputs S14 and S15 to activate first and second refrigeration stages 111, 115, which each include a compressor 54 (for a dual stage refrigeration-based process chiller 18). Each compressor 54 is provided with a compressor contact C1, C2 that can be selectively energized by the microcontroller 92 to activate the respective compressors 54. Likewise, a fan contact F1, F2 can be selectively energized when the refrigeration stages 111, 115 are energized to activate a fan (not shown) that can optionally be provided to blow air over the condenser conduit 56 in which the refrigerant can at least partially condense before being introduced to the evaporator 23. Although described as a fan contact F1, F2, it is to be noted that the fan contacts F1, F2 can be energized to activate a pump that delivers cooling water to the condenser conduit 56 and the like. A solenoid 112 is also provided to actuate a valve that can selectively add and remove each individual stage from the chilling cycle as desired.

Figure 2B:
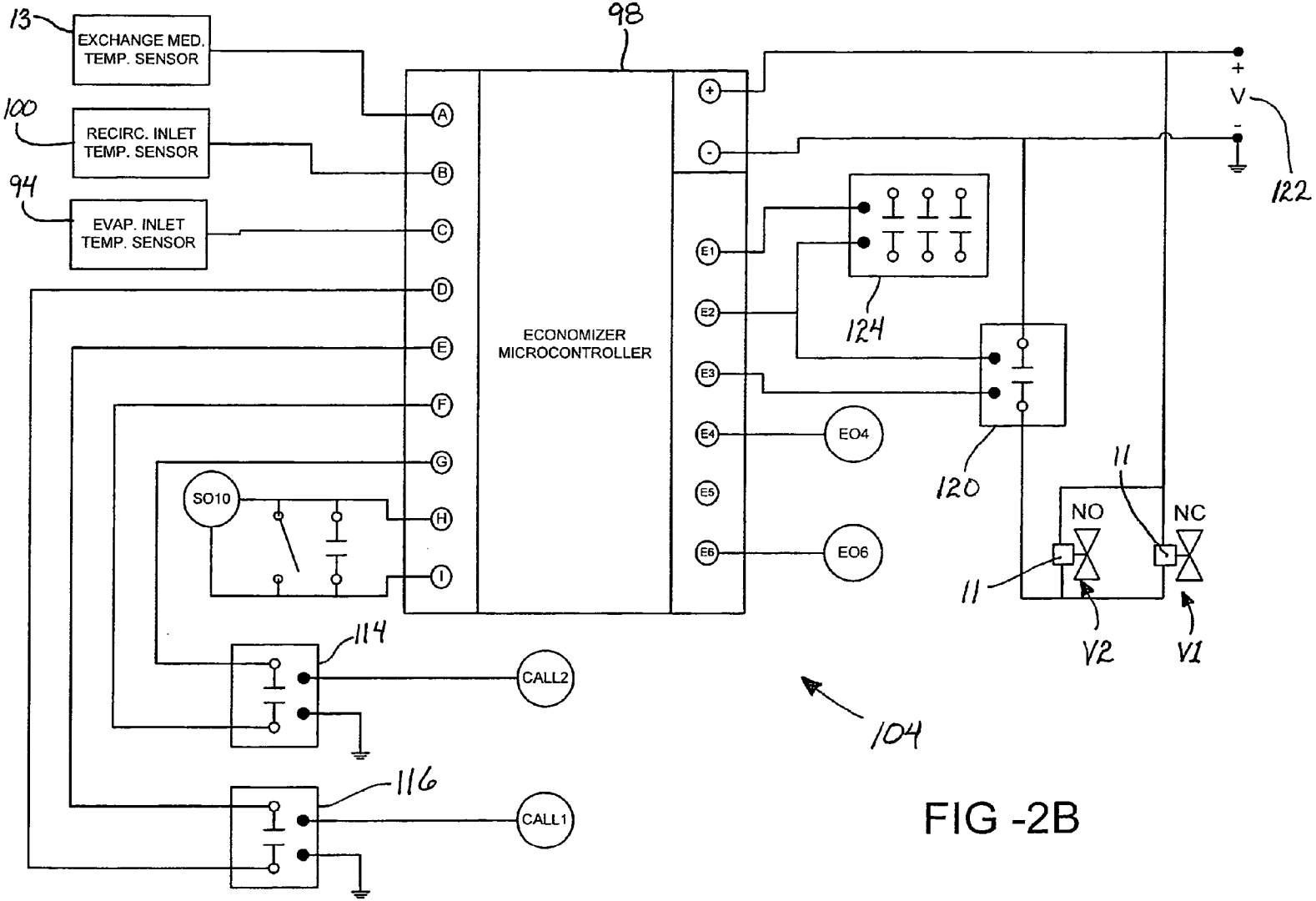
FIG. 2B is a block diagram showing an embodiment of a microprocessor-based control system of an economizer module that can cooperate with, or operate in lieu of a refrigeration system to chill a process fluid.

Each output signal CALL1, CALL2 emitted by the outputs S14, S15 as the call for cooling is transmitted to energize and close normally-open cooling-call relays 114, 116 provided to each stage of the economizer control system 104 shown in FIG. 2B. Although two stages are shown in FIG. 2A, FIGS. 3A and 3B illustrate single stage refrigeration-based process chillers 18 that utilize a single call-for-cooling signal output from one of the outputs S14, S15 of the microcontroller 92 in FIG. 2A. The call for cooling output signals CALL1, CALL2 cause the normally-open cooling-call relays 114, 116 to close, which in turn connect inputs D and E to each other, as well as inputs F and G, of the economizer microcontroller 98, respectively. This informs economizer microcontroller 98 that a call for cooling has been made and activates a control routine to be performed by the economizer microcontroller 98 as described in detail below to determine if conditions allow for chilling of the process fluid with the dry cooler 10.

The stock control system 90 can optionally be a dedicated control system for controlling only the operation of the refrigeration-based process chiller 18. The signals output from outputs S14 and S15 of the stock microcontroller 92 are those that would be output to control a refrigeration-based process chiller 18 in the absence of the dry cooler 10. The first and second compressor lockout relays 108, 110 are normally closed, and thus, allow the first and second refrigeration stages to be activated by the call for cooling output signals CALL1, CALL2. Such a dedicated system lacks jacks or other external inputs to which supplemental control devices can be coupled to interact with the control system 90. For such embodiments, an economizer control system 104 such as that shown in FIG. 2B can utilize existing control signals transmitted from the stock microcontroller 92 of the control system 90 for the refrigeration-based process chiller 18 to control cooperation of the dry cooler 10 and refrigeration-based process chiller 18 to efficiently chill the process fluid. By utilizing control signals transmitted to control operation of the refrigeration-based process chiller 18, the dry cooler 10 and economizer control system 104 can optionally be added as an aftermarket addition, or alternately, manufactured as a combined unit.

FIG. 2B shows a block diagram illustrating an embodiment of the economizer control system 104. The economizer microcontroller 98 is operatively coupled to a plurality of valves V1, V2 for controlling the flow of the process fluid during chilling operations and selectively connecting and disconnecting the dry cooler 10 from the chilling cycle depending on at least a temperature of the exchange medium. An example of a suitable economizer microcontroller 98 is a Delta, DSC-633 Controller, for example. The economizer microcontroller 98 can communicate through appropriate isolation measures to selectively cause the solenoid 11 provided to each valve V1, V2 to become energized and open and close those valves V1, V2. Economizer microcontroller 98 in FIG. 2B can close the electrical circuit to energize the solenoid 11 of each valve V1, V2 by closing normally-open relay 120. Output E2 of the economizer microcontroller 98 can optionally be grounded or establish a common voltage while output E3 of the economizer microcontroller 98 can be energized to establish a potential difference at the relay 120. This causes the normally-open relay 120 to close, thereby completing the circuit including the valves V1, V2, which are also operatively coupled to be powered by power source 122 supplying the economizer microcontroller 98.

Valve VI is normally closed to remove the dry cooler 10 from fluid flow pathway referred to herein as the chilling cycle through which the process fluid is to flow and be chilled. In contrast, the valve V2 is normally open, allowing the process fluid to bypass the dry cooler 10 en route to being chilled by the refrigeration-based process chiller 18 according to the chilling cycle indicated by the arrows 71 and the bolded fluid flow path shown in FIG. 3A. FIG. 3A shows that the bolded fluid path, or first fluid pathway, and the pipes 24, 25 all extend from separate openings in the storage tank 22. When the call for cooling output signals CALL I, CALL2 are issued by the stock control system 90, suitable control signals are transmitted to the economizer microcontroller 98, causing it to close relay 120 and energize the solenoid 11 provided to each of the valves VI, V2. Since one valve VI is normally closed and the other valve V2 is normally open, energizing the solenoid provided to each of the valves VI, V2 includes the dry cooler 10 in the chilling cycle, as shown by arrows 65 and the bolded fluid flow path in FIG. 3B, instead of bypassing the dry cooler 10.

The common output E2 of economizer microcontroller 98 is also applied to economizer fan contact 124 that can be energized to selectively activate and deactivate the fan 52 or other device for forcing the fluid exchange medium over the conduit 50. Energizing the economizer fan contact 124 is accomplished by transmitting an appropriate control signal from output E1 of the economizer microcontroller 98.

Figure 4A:
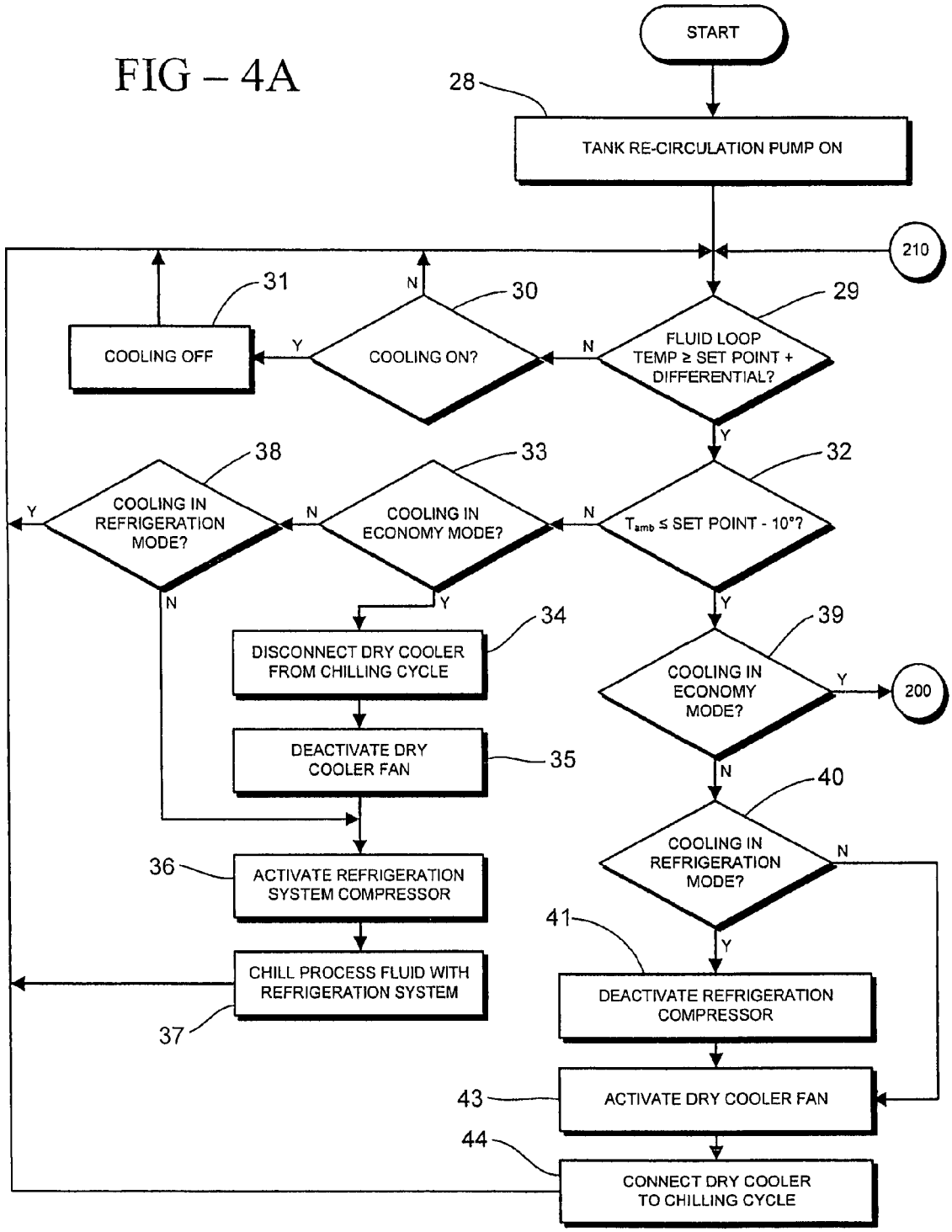
FIG. 4A is a flow chart illustrating a portion of the microprocessor control sequence of operations.

Operation of the process fluid chiller system 12 can best be understood with reference to FIG. 4A, as well as FIGS. 3A and 3B depending on the operational mode in which the process fluid chiller system 12 is operating. At step 26 in FIG. 4A, the valves V1 and V2 are initialized to their default settings. Embodiments of the present invention include a normally-closed valve V1 and a normally-closed valve V2, so the initialization process can include a configuration of valves V1 and V2 to their normal positions, resulting in a configuration that removes the dry cooler 10 from the chilling cycle. With the valves V1 and V2 in their normal orientations, the chilling cycle begins when the process fluid leaves the storage tank 22, flows through the evaporator 23 and returns to the storage tank 22.

Pump 15*a* is activated at step 28 upon the transmission of an appropriate signal from the stock microprocessor 92 to withdraw the process fluid from the storage tank 22 and impart a pumping force thereon that causes the process fluid to travel through the chilling cycle. Continuous circulation of the process fluid through the chilling cycle promotes thorough mixing of the process fluid within the storage tank 22.

With the process fluid chiller system 12 initialized and operating in circulation mode, the process fluid is not yet undergoing any chilling operations. The process fluid can optionally flow through the evaporator 23 without operation of the compressor 54 of the refrigeration system. Instead of removing thermal energy from the process fluid, the evaporator 23 simply acts as a conduit through which the process fluid can travel as part of the chilling cycle en route to returning to the storage tank 22.

The recirculation inlet temperature sensor 100 senses the temperature of the bulk process fluid leaving the storage tank 22 and circulated through the chilling cycle. But regardless of the specific location of the temperature sensor 68, it is operatively coupled to the stock microcontroller 92 to transmit a signal indicative of a temperature of the process fluid to indicate when chilling of the process fluid is desirable. Based at least in part on the signal transmitted by the recirculation inlet temperature sensor 100, it is determined at step 29 of the method whether chilling of the process fluid is appropriate.

The decision at step 29 determines whether chilling of the process fluid is appropriate by determining whether the sensed process fluid temperature is greater than or equal to a sum of the set point temperature input via the user interface 61 and an allowable temperature differential. The set point temperature can be input by the operator via the user interface 61 to specify a desired temperature of the process fluid to adequately cool the process load 17 under particular conditions. Further, the temperature differential defines an allowable margin of temperatures over which the temperature of the process fluid can vary before chilling becomes necessary. The temperature differential can optionally be adjusted to define how closely the temperature of the process fluid should be maintained relative to the set point temperature.

If, at step 29, it is determined that chilling of the process fluid is not called for, it is determined whether the process fluid is presently being chilled at step 30. If not, the logic flow enters a loop by returning to step 29 until it is determined that the process fluid has risen to an upper threshold temperature. But if it is determined at step 30 that the process fluid is being chilled, chilling is discontinued at step 31 first before entering the loop by returning to step 29. Then, circulation of the process fluid can continue according to the circulation mode until further chilling of the process fluid is called for.

When a call for chilling of the process fluid is determined to be necessary at step 29, the call for cooling output signals CALL1, CALL2 are transmitted from outputs S14 and S15 of the stock microcontroller 92, thereby closing normally-open, cooling-call relays 114, 116. Closing of the cooling-call relays 114, 116 creates a short between inputs F and G, as well as D and E, thereby notifying the economizer microcontroller 98 that a call for chilling has been made. Again, the two call-for-cooling output signals CALL1, CALL2 are for dual-stage refrigeration embodiments, wherein one of the call for cooling output signals CALL1, CALL2 causes each of the cooling-call relays 114, 116 to close. However, it should be noted that the refrigeration-based process chiller 18 can include a single stage refrigeration system, requiring only a single call for cooling output signal to be transmitted to the economizer control system 104. Further, depending on the extent to which the process fluid must be chilled to bring its temperature in compliance with the desired temperature, one or more of the refrigeration stages 111, 115 can be selectively energized as needed, and in any combination, to satisfy the demands for chilling the process fluid.

It is determined at step 32 whether conditions are suitable for using the dry cooler 10 in lieu of, or to supplement chilling of the process fluid by the refrigeration system of the refrigeration-based process chiller 18. Use of the dry cooler 10 as part of the chilling cycle is determined to be appropriate when the temperature of the exchange medium $T_{amb}$, as measured by the exchange medium temperature sensor 13, is a specific degree colder than the set point temperature desired of the process fluid. As shown in FIG. 4A, the process fluid chiller system 12 includes the dry cooler 10 in the chilling cycle when the temperature of the exchange medium $T_{amb}$ is at least 10° F. colder than the set point temperature specified for the process fluid. However, it is to be noted that the temperature gradient between the set point temperature and the temperature of the exchange medium $T_{amb}$ can be any desired temperature difference, and can optionally be programmable by the operator via the user interface 61.

The answer to the decision at step 32 dictates whether the process fluid chiller system 12 is operated in "Refrigeration Mode" or "Economy Mode." Answering the decision at step 32 in the negative causes the process fluid chiller system 12 to chill the process fluid in Refrigeration Mode, while an affirmative answer to step 32 causes the process fluid chiller system 12 to chill the process fluid in Economy Mode. Refrigeration Mode corresponds to a chilling mode in which the chilling cycle chills the process fluid by removing thermal energy from the process fluid as a result of the refrigerant changing from a liquid to a gas in the evaporator 23. This mode also requires operation of the compressor 54 of the refrigeration system to circulate the refrigerant that eventually removes the thermal energy from the process fluid.

In contrast, when the process fluid chiller system 12 is operating in Economy Mode, operation of the compressor 54 is not absolutely necessary to chill the process fluid. Instead, the dry cooler 10 is connected in series with the evaporator 23 in the chilling cycle and chilling of the process fluid is accomplished by removing the thermal energy from the process fluid and transferring at least a portion of that removed thermal energy to the exchange medium instead of the refrigerant. Chilling the process fluid in Economy Mode can be completely accomplished by circulating the process fluid through the dry cooler 10 without any contribution from the refrigeration system toward the removal of thermal energy from the process fluid. Or, according to alternate embodiments, chilling of the process fluid in Economy Mode can be accomplished by transferring at least a portion of the thermal energy from the process fluid to the exchange medium with the dry cooler 10, in combination with transferring an additional portion of thermal energy from the process fluid to the refrigerant with the refrigeration system of the refrigeration-based process chiller 18.

Referring once again to the flow diagram of FIG. 4A, if it is determined at step 32 that the temperature of the exchange medium $T_{amb}$ is not appropriate for chilling the process fluid in Economy Mode, it must be determined if the process fluid chiller system 12 is already operating in Economy Mode at step 33. Such could be the case as the day progresses closer to afternoon where the temperature of the exchange medium $T_{amb}$ rises while the process fluid chiller system 12 is in Economy Mode. If, in fact, the process fluid chiller system 12 is already operating in Economy Mode and the temperature of the exchange medium $T_{amb}$ as measured by exchange medium temperature sensor 13 becomes unsuitable for operating in the Economy Mode, the economizer microcontroller 98 shown in FIG. 2B deactivates outputs E1, E3, E4 and E6.

Deactivation of output E3 of the economizer microcontroller 98 disconnects the dry cooler 10 from the chilling cycle by de-energizing the solenoid 11 provided to each of the valves V1 and V2. This allows the valves V1 and V2 to return to their normal states. Valve V1 is closed and Valve V2 is opened to disconnect the dry cooler 10 from the chilling cycle at step 34, causing the process fluid to bypass the dry cooler 10 en route to the evaporator 23 of the refrigeration-based process chiller 18. Likewise, deactivating output E1 of the economizer microcontroller 98 de-energizes the economizer fan contact 124, causing deactivation of the fan 52 blowing the air over the conduit 50 at step 35.

Deactivation of outputs E4 and E6 of the economizer microcontroller 98 shown in FIG. 2B terminate the signals E04 and E06 that bias the first and second compressor lockout relays 108, 110 open, thereby locking out the refrigeration stages 111, 115. Termination of the signals E04 and E06 allow the first and second compressor lockout relays 108, 110 to return to their normally-closed orientation. Since the call for cooling output signals CALL1, CALL2 are active as a result of the sensed temperature of the process fluid determined at step 29, the call for cooling output signals CALL1, CALL2 cause at least one compressor 54 of the refrigeration-based process chiller 18 to be activated at step 36. Activation of the compressor 54 of the refrigeration-based process chiller 18 causes the thermal energy from the process fluid flowing through the evaporator 23 to be transferred to the refrigerant at step 37, resulting in the process fluid being chilled by the refrigeration-based process chiller 18 in the Refrigeration Mode. The logic flow of the method again enters the loop by returning to step 29.

If, at step 33, it is determined that the process fluid chiller system 12 is not already chilling the process fluid in Economy Mode, it is determined whether the process fluid is being chilled in Refrigeration Mode at step 38. Since chilling of the process fluid in refrigeration mode is desirable at step 37, the logic flow enters the loop and returns to step 29 without further action being required if the decision at step 38 is answered in the affirmative. But if it is determined at step 38 that the process fluid is not already being chilled in Refrigeration Mode, the stock microcontroller 92 activates outputs S14 and S15 to transmit call for cooling output signals CALL1, CALL2 that energize one or more compressors 54 of the refrigeration-based process chiller 18 to chill the process fluid in Refrigeration Mode at step 36. Since the temperature of the exchange medium $T_{amb}$ is not conducive to chilling the process fluid with the dry cooler 10, the economizer microcontroller 98 is not transmitting signals EO4 or EO6 from outputs E4 or E6, respectively. This allows the first and second compressor lockout relays 108, 110 to remain in their normal positions (i.e., closed) and conduct the call for cooling output signals CALL1, CALL2 to energize one or more refrigeration stages 111, 115, and accordingly, activation of the compressor 54 of the refrigeration system at step 36. With the compressor 54 activated, the process fluid is chilled by the refrigeration system in the Refrigeration Mode. The logic flow of the method again enters the loop by returning to step 29.

Figure 4B:
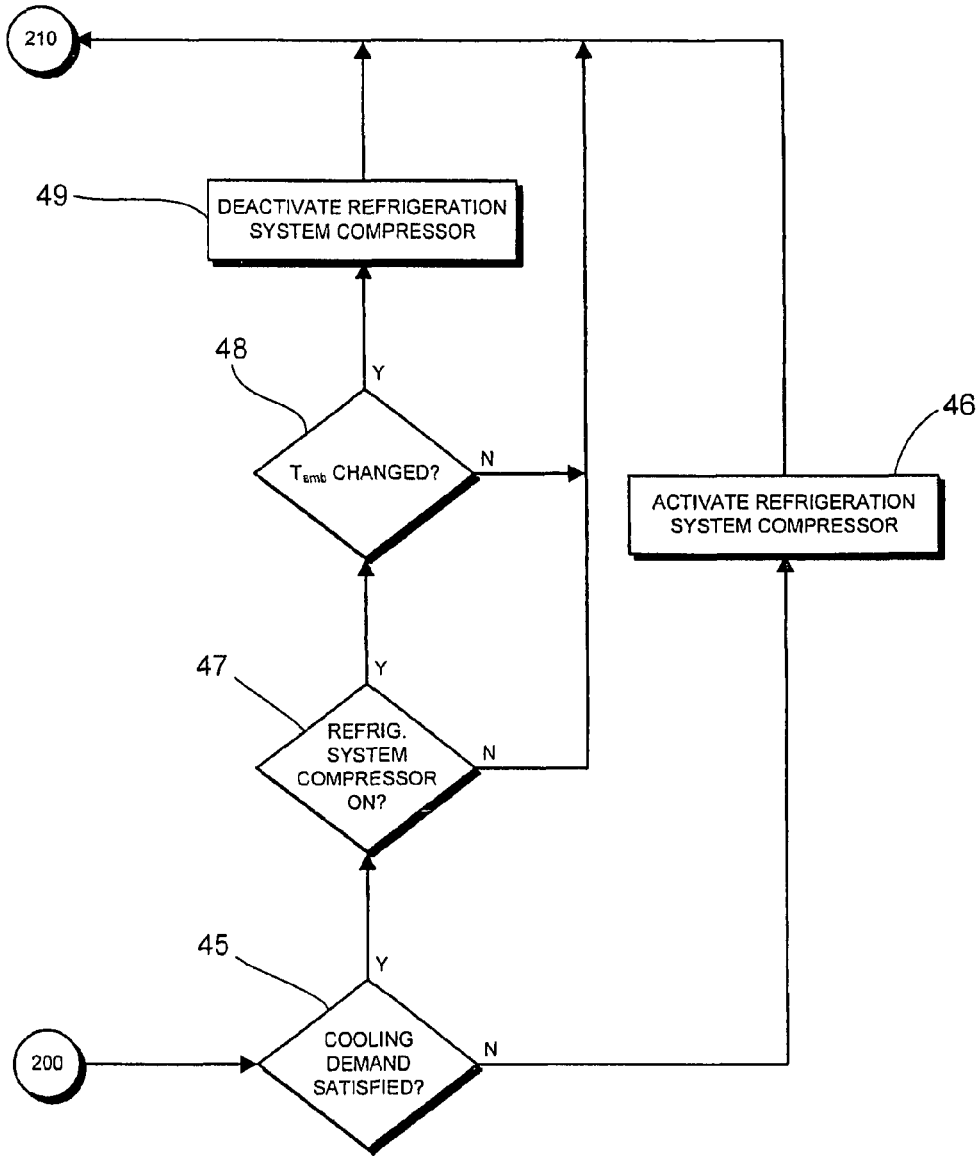
FIG. 4B is a flow chart illustrating a portion of the microprocessor control sequence of operations.

The preceding method steps resulting from the decision made at step 32 describe the commencement of process fluid chilling in Refrigeration Mode. However, if at step 32 it is determined by the economizer microcontroller 98 that the temperature of the exchange medium $T_{amb}$ is suitable for chilling of the process fluid in Economy Mode, the current operational mode of the process fluid chiller system 12 is again evaluated at steps 39 and 40. If, at step 39 it is determined that the process fluid chiller system 12 is chilling the process fluid in the Economy Mode the progress of cooling made by the process fluid chiller system 12 is analyzed to determine whether the process fluid is being sufficiently cooled to satisfy the demand for cooling at step 45, as shown in FIG. 4B. At step 45, the process fluid chiller system 12 senses at least one temperature that is indicative of the amount of thermal energy being removed from the process fluid while the process fluid chiller system 12 is operating in the Economy Mode, which again, includes any operating configuration in which the dry cooler 10 is connected to the chilling cycle. For example, the progress of cooling while the process fluid chiller system 12 is in Economy Mode can be evaluated by comparing the temperature of the process fluid sensed by recirculation inlet temperature sensor 100 and the temperature of the process fluid sensed by evaporation inlet temperature sensor 94. If the temperature drop from the temperature measured by recirculation inlet temperature sensor 100 to the temperature measured by evaporation inlet temperature sensor 94, as evaluated by the economizer microcontroller 98, does not exceed a predetermined temperature drop, the economizer microcontroller 98, at step 45, determines that additionally cooling is required and causes activation of the compressor 54 of the refrigeration system at step 46. And as described elsewhere, the economizer microcontroller 98 can deactivate outputs E4 and E5, thereby terminating the signals E04 and E06, respectively, which cause the compressor 54 to be locked out. With signals E04 and E06 terminated, the normally closed relays 108, 110 can once again allow the compressor 54 provided to each stage 111, 115 to be energized. Thus, according to this embodiment of the process fluid chiller system 12, both the dry cooler 10 and at least one compressor 54 are operating simultaneously in the Economy Mode. At least a portion of the thermal energy is removed by the dry cooler 10, and another portion of thermal energy is removed from the process fluid flowing through the evaporator 23 of the refrigeration system to effectively chill the process fluid as desired.

It is worth noting, however, that if the economizer microcontroller 98 determines at step 45 that the temperature drop from recirculation inlet temperature sensor 100 to evaporation inlet temperature sensor 94 is negative (i.e., the temperature has gone up), then the economizer microcontroller 98 can optionally jump directly to step 33 shown in FIG. 4A. According to other embodiments, if the economizer microcontroller 98 determines such a temperature increase has occurred at step 45, the economizer microcontroller 98 can cause activation of the at least one compressor 54 at step 46, and allow the logic to enter the loop by returning to step 29. Then, the economizer microcontroller 98 will make the determination of whether the temperature of the exchange medium $T_{amb}$ is suitable for continuing chilling of the process fluid in Economy Mode at step 32.

If, however, it is determined at step 45 that the cooling demands are being adequately satisfied while the process fluid chiller system 12 is operating in the Economy Mode, it is determined whether one or more compressors 54 are operating to supplement the removal of thermal energy from the process fluid by the dry cooler 10 at step 47. If not, then the logic flow of the method can enter the loop by returning to step 29 without further intervention by the economizer microcontroller 98 since the dry cooler 10 is adequately cooling the process fluid without the assistance of one or more stages 111, 115 of the refrigeration system. But if the cooling demands are being adequately satisfied and a compressor 54 provided to at least one stage 111, 115 of the refrigeration system is operating, then it is determined at step 48 if the temperature of the exchange medium $T_{amb}$ has suitably fallen to a temperature that will allow the dry cooler 10 to sufficiently chill the process fluid without the aid of the stage(s) 111, 115 of the refrigeration system that are currently operating. If so, then the compressor(s) 54 of the refrigeration stage(s) 111, 115 in operation are deactivated at step 49, and the logic flow of the present method enters the loop by returning to step 29. But if not, the compressor 54 of each refrigeration stage 111, 115 in operation is not deactivated before the logic flow enters the loop by returning to step 29 in FIG. 4A.

Such operation allows the process fluid chiller system 12 to activate one or more compressors 54 as needed when sufficient cooling of the process fluid is not being accomplished by the dry cooler 10 alone. Minimizing operation of the one or more compressors 54 allows for minimal consumption of electric energy to adequately chill the process fluid.

If, however, it is determined at step 39 that chilling of the process fluid in the Economy Mode is not currently underway, at step 40 it is determined if chilling of the process fluid in the Refrigeration Mode is being performed. If so, the economizer microcontroller 98 activates outputs E4 and E6 to transmit signals E04 and E06 that cause the first and second compressor lockout relays 108, 110 to be opened, resulting in deactivation of the refrigeration stages 111, 115 at step 41. Further, the economizer microcontroller 98 activates output E1 to energize the economizer fan contact 124 at step 43, and activates output E3 to complete the circuit including the valves V1, V2, thereby energizing the solenoid 11 of each valve V1, V2 to connect the dry cooler 10 to the chilling cycle at step 44. The logic flow of the present method can again enter the loop by returning to step 29 and repeatedly monitoring the temperature of the process fluid with the recirculation inlet temperature sensor 100.

If, however, it is determined at step 40 that the process fluid chiller system 12 is not chilling the process fluid in Refrigeration Mode, then it is unnecessary to deactivate the compressor 54 as it is already inactive. Instead, the economizer microcontroller 98 activates output E1 to energize the economizer fan contact 124 at step 43, and activates output E3 to complete the circuit including the valves V1, V2, thereby energizing the solenoid 11 of each valve V1, V2 to connect the dry cooler 10 to the chilling cycle at step 44. With the dry cooler 10 operational and included in the chilling cycle, the process fluid can be chilled with the dry cooler 10, either exclusively, or in combination with the refrigeration-based process chiller 18. The logic flow of the present method can again enter the loop by returning to step 29 and repeatedly monitoring the temperature of the process fluid with the recirculation inlet temperature sensor 100.

A brief overview of this method of operation is provided with reference again to the illustrative embodiment of a water chiller including a dry cooler 10 that comprises a liquid-to-air heat exchanger that transfers heat from the process fluid to ambient air being blown over the conduit 50. When the process fluid chiller system 12 is activated it is initialized to circulation mode. As shown in FIG. 3A, valve V1 is in its normal closed position to disconnect the dry cooler 10 from the chilling cycle. Valve V2 is also in its normally open position to establish a closed-loop fluid flow pathway that bypasses the dry cooler 10. The circulation pump 15*a* is caused to be activated and circulates the water from the storage tank 22 through valve V2 and through the remainder of the chilling cycle before returning to storage tank 22. Once activated, the circulation pump 15*a* operates continuously whenever the stock microcontroller 92 is powered on to maintain a tank mix, thereby minimizing significant temperature gradients within the storage tank 22. The closed valve V1 prevents the water from flowing to the dry cooler 10 and a system of check valves 8, 9 minimize any backflow of water into the return pipe 21 leading away from the dry cooler 10 and upstream towards the circulation pump 15*a*. The water can be returned to the storage tank 22 through the evaporator 23 as shown by arrows 71 and the bolded fluid flow path in FIG. 3A.

When the temperature of the water rises above a predetermined temperature, the recirculation inlet temperature sensor 100 emits a temperature signal that is to notify the stock microcontroller 92 of the undesirable temperature increase experienced by the process fluid. Upon receiving this notification, the stock microcontroller 92 activates outputs S14 and S15 to emit the call for cooling output signals CALL1, CALL2. One or more cooling-call relays 114, 116 are wired to receive the call for cooling output signals CALL1, CALL2, thereby causing the normally open cooling-call relays 114, 116 to close. Closing of the cooling-call relays 114, 116 shorts two sets of inputs F and G, D and E, respectively, which informs the economizer microcontroller 98 that a call for cooling has been made by the stock microcontroller 92.

Upon recognizing that a call for cooling of the process fluid has been made, the economizer microcontroller 98 is to determine the proper steps to be taken to accomplish the desired chilling of the process fluid based at least in part on the temperature of the ambient air to be used as the exchange medium. The economizer microcontroller 98 reads a temperature signal transmitted by the exchange medium temperature sensor 13 to determine if the temperature of the ambient air $T_{amb}$ is sufficiently lower than the temperature of the process fluid to facilitate removing at least a portion of the thermal energy to be removed from the process fluid with the dry cooler 10. If the temperature of the air $T_{amb}$ is low enough, the economizer microcontroller 98 will activate outputs E1 and E3, while grounding output E2 to close the normally-open relays 120, 124 that connect the dry cooler's fan 52 and valves V1, V2 to a power source. Energizing the fan 52 and the solenoid 11 provided to valves V1, V2 activates the fan 52 to blow the ambient air over the conduit 50 of the dry cooler 10, and opens valve V1 while closing valve V2 to connect the dry cooler 10 in series with the evaporator 23 as part of the chilling cycle. Accordingly, the water pumped by the circulation pump 15*a* is chilled by the dry cooler 10 in what is referred to herein as the Economy Mode, and optionally also by the refrigeration process of the refrigeration-based process chiller 18. The chilling cycle while the process fluid chiller system 12 is operating in the Economy Mode is illustrated by arrows 65 and the bolded fluid flow path in FIG. 3B.

While the water is being chilled in the Economy Mode, the economizer microcontroller 98 initially activates outputs E4 and E6 to transmit control signals E04 and E06 to normally-closed first and second compressor lockout relays 108, 110. Control signals E04 and E06 cause these compressor lockout relays 108, 110 to open, thereby preventing operation of the one or more refrigeration stages 11, 115 of the refrigeration-based process chiller 18. This lockout of the compressor lockout relays 108, 110 can be maintained for a predetermined period of time to give the dry cooler 10 an opportunity to remove enough thermal energy from the water without the assistance of the refrigeration system of the refrigeration-based process chiller 18.

The temperature of the water flowing through the chilling cycle can be substantially continuously monitored by evaporation inlet temperature sensor 94 operatively coupled to input C of the economizer microcontroller 98 as the water returns to the storage tank 22. Based at least in part on the temperature signal emitted by the evaporation inlet temperature sensor 94, the economizer microcontroller 98 can determine whether enough thermal energy is being removed from the water by the dry cooler 10 to suitably lower the temperature of the water to the desired set point. If the economizer microcontroller 98 determines that the dry cooler 10 is not removing enough thermal energy from the water to satisfy the chilling demands, then the economizer microcontroller 98 can deactivate one or both of its outputs E4, E6, and accordingly, discontinue the transmission of one or both of the control signals E04, E06, respectively. Alternate embodiments can deactivate one or both of the economizer microcontroller's outputs E4, E6 based at least in part on the difference between the water temperature measured by the recirculation inlet temperature sensor 100 and the evaporation inlet temperature sensor 94 is not sufficiently large to chill the water a desired rate. Terminating one or more of the control signals E04, E06 results in the activation of one or more refrigeration stages 111, 115, respectively to assist the dry cooler 10 in the chilling of the water. Economizer microcontroller 98 can selectively cause activation and deactivation of one or more refrigeration cycles 111, 115 provided to the refrigeration-based process chiller 18 as appropriate to satisfy the demand for chilling of the water.

If, at any point, the economizer microcontroller 98 receives a temperature signal transmitted by the exchange medium temperature sensor 13 indicating that the ambient air is warmer than the water temperature while chilling of the water is necessary, the economizer microcontroller 98 causes the process fluid chiller system 12 to enter Refrigeration Mode.

The economizer microcontroller 98 deactivates one or more of its outputs E4, E6 to allow a suitable number of refrigeration cycles 111, 115 to become energized to chill the water. The compressor 54 provided to each active refrigeration cycle 111, 115 is activated to circulate the refrigerant into the evaporator 23, where it at least partially evaporates into a gas and thereby removes thermal energy from the water flowing through the evaporator 23. The chilled water in both Economy and Refrigeration Modes is returned to the storage tank 22 and combined with the bulk water therein.

Once the temperature of the water is lowered to the desired set point or below, chilling of the water can be discontinued and the process fluid chiller system 12 returned to circulation mode. In circulation mode, the pump 15*a* simply circulates the water through the chilling cycle without the compressor 54 activated, and without the dry cooler 10 connected to the chilling cycle. To return the process fluid chiller system 12 to circulation mode, the call for cooling output signals CALL1, CALL2 are terminated by the stock microcontroller 92, thereby de-energizing any active refrigeration stages 111, 115 and indicating to the economizer microcontroller 98 that chilling of the water is no longer needed. The chilling cycle through which the water flows while the process fluid chiller system 12 is in Refrigeration Mode and circulation mode is shown by arrows 71 and the bolded fluid flow path in FIG. 3A.

Figure 5:
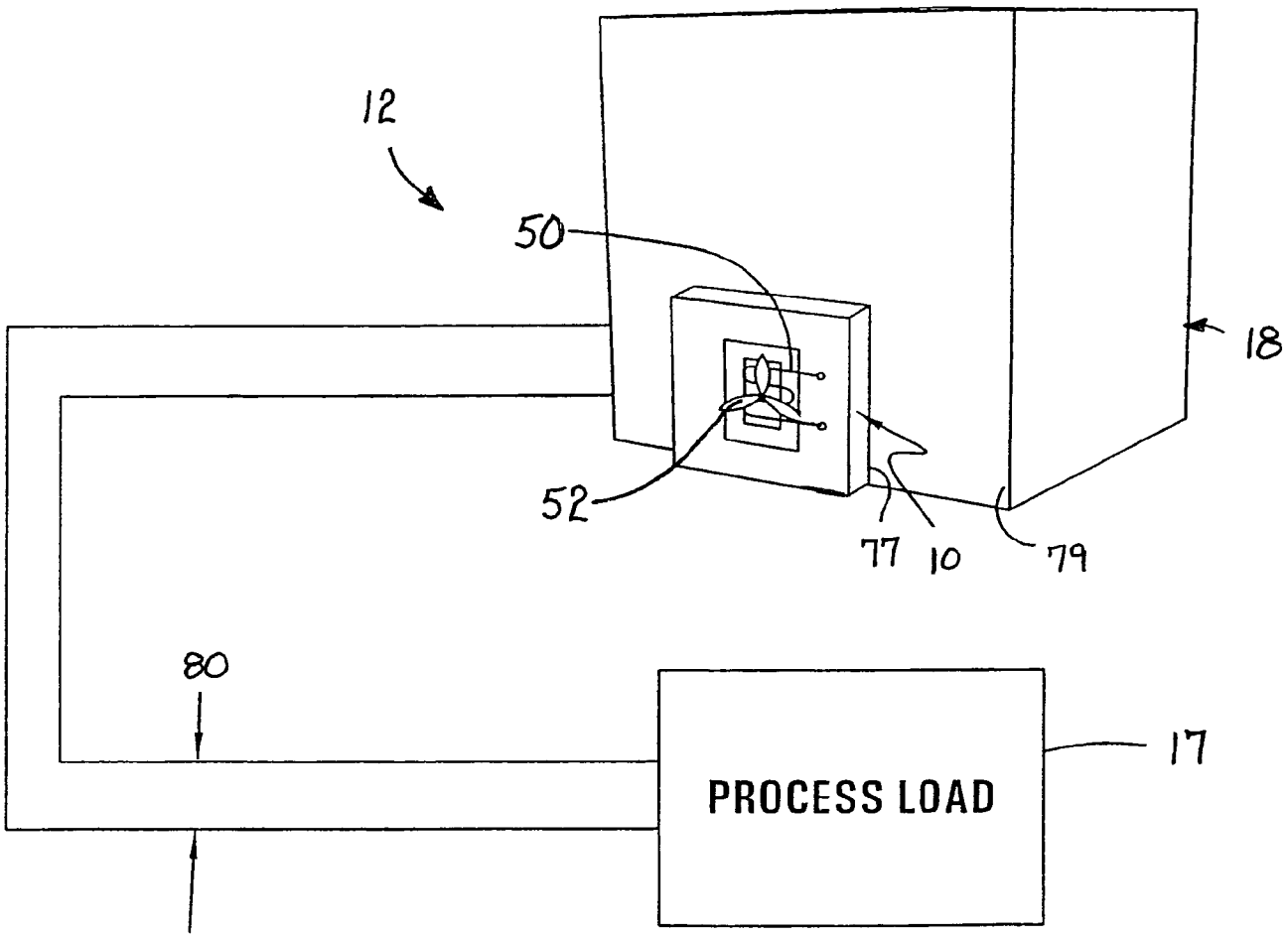
FIG. 5 is a schematic view of a unitary embodiment of the invention showing the dry cooler mounted on the outside of the process chiller housing.

FIG. 5 illustrates an alternate arrangement of a process fluid chiller system 12 according to an embodiment of the present invention. A dry cooler 10 in the form of a fan-powered heat exchanger is combined with a refrigeration-based process chiller 18, forming parts of the same, unitary cabinet assembly. A rear housing wall 38 of the dry cooler 10 can be coupled to a housing wall 79 of the refrigeration-based process chiller 18. Cool fluid supply pipe 80 establishes fluid communication between the refrigeration-based process chiller 18 according to this embodiment and the process load 17. Similarly, a return pipe 82 is provided to establish fluid communication between the process load 17 and the refrigeration-based process chiller 18. Chilled water is transported within the cool fluid supply pipe 80 from the storage tank 22 and the process load 17, while the water warmed by thermal energy taken from the process load 17 is returned to the refrigeration-based process chiller 18 via the return pipe 82.

Similar to the previously discussed embodiments, the dry cooler 10 shown in FIG. 5 also includes a conduit 50 over which ambient air can be blown by a fan 52, which is also operatively coupled to the dry cooler 10 and refrigeration-based process chiller 18 combination. Just as before, the conduit 50 can selectively be connected and disconnected to the chilling cycle to transport water through the dry cooler 10 when conditions are suitable for chilling the water with ambient air as discussed above.

Illustrative embodiments have been described, hereinabove. It will be apparent to those skilled in the art that the above devices and methods may incorporate changes and modifications without departing from the general scope of this invention. It is intended to include all such modifications and alterations in so far as they come within the scope of the appended claims.

What is claimed is:

1. A process-fluid chiller system for chilling a process fluid and comprising:

a process load being a heat source;

a storage tank in which the process fluid can be stored;

first and second pipes extending from respective first and second openings in the storage tank and placing the storage tank in fluid communication with the process load for transferring heat from the process load to the process fluid;

a first fluid pathway communicating process fluid away from the storage tank and back to the storage tank and extending from a third opening in the storage tank;

a refrigeration system that can be selectively activated to chill the process fluid, the refrigeration system comprising an evaporation device disposed along the first fluid pathway for evaporating a refrigerant from a liquid state to a gaseous state while drawing heat from the process fluid and a compressor for elevating a pressure of the refrigerant in the gaseous state;

a second fluid pathway extending between first and second ends wherein both of the first and second ends are in fluid communication with the first fluid pathway and are upstream of the evaporation device, wherein the first fluid pathway extends in parallel to the second fluid pathway between said first and second ends;

a closed-loop heat exchanger disposed along the second fluid pathway and receiving an exchange medium to draw heat from the process fluid;

a valving arrangement to selectively divert process fluid to the second fluid pathway;

a temperature sensor for sensing a temperature of the exchange medium received by the closed-loop heat exchanger; and a control system operable to receive a signal from the temperature sensor corresponding to the temperature of the exchange medium and operable to control activation of the refrigeration system and operable to control the valving arrangement to selectively place the closed-loop heat exchanger in fluid communication with the storage tank by controlling the valving arrangement in response to the signal from the temperature sensor.

2. The process-fluid chiller system according to claim 1 wherein the exchange medium is ambient air and the closed-loop heat exchanger further comprises a conduit for directing the flow or process fluid and a fan for blowing ambient air over the conduit to transfer thermal energy from the process fluid to the ambient air.

3. The process-fluid chiller system according to claim 2, wherein the conduit is fabricated from copper, aluminum, or an alloy thereof.

4. The process-fluid chiller system according to claim 2, wherein the conduit is fabricated from a material having a coefficient of thermal conductivity of at least 15 W/mK.

5. The process-fluid chiller system according to claim 1 further comprising:

a pump disposed along the first fluid pathway upstream of both ends of the second fluid pathway for drawing the process fluid from the storage tank.

6. The process-fluid chiller system according to claim 1, wherein the system can operate in one of the modes selected from the group comprising: activating the refrigeration system, placing the closed-loop heat exchanger in fluid communication with the storage tank, and both activating the refrigeration system and placing the closed-loop heat exchanger in fluid communication with the storage tank.

* * * * *